United States Patent [19]

Uchida et al.

[11] 4,341,026

[45] Jul. 27, 1982

[54] BUCKET ASSEMBLY FOR EARTHMOVING MACHINES CAPABLE OF SIDE DUMPING AS WELL

[75] Inventors: Tomio Uchida, Ebetsu; Kisaburo Otabe, Isehara, both of Japan

[73] Assignees: Caterpillar Mitsubishi Ltd.; Hokkaido Construction Equipment Sales, Ltd., both of Japan

[21] Appl. No.: 203,722

[22] Filed: Nov. 3, 1980

[30] Foreign Application Priority Data

Nov. 30, 1979 [JP] Japan ..... 54-154425
Sep. 24, 1980 [JP] Japan ..... 55-131599

[51] Int. Cl.[3] ..... E02F 3/76
[52] U.S. Cl. ..... 37/117.5; 414/705
[58] Field of Search ..... 37/117.5, 118; 414/705

[56] References Cited

U.S. PATENT DOCUMENTS

| | | | |
|---|---|---|---|
| 3,198,358 | 8/1965 | Gardner | 37/117.5 X |
| 3,268,101 | 8/1966 | Pensa | 37/117.5 X |
| 3,313,437 | 4/1967 | Eriksson | 37/117.5 X |
| 3,402,841 | 9/1968 | Salna et al. | 37/117.5 X |
| 3,523,622 | 8/1970 | Burcham et al. | 414/705 |
| 3,531,007 | 9/1970 | Leijon | 414/705 |
| 3,556,330 | 1/1971 | Keskitalo et al. | 414/705 |
| 3,885,694 | 5/1975 | Uchida et al. | 414/705 |
| 3,907,143 | 9/1975 | Brown et al. | 414/705 |

FOREIGN PATENT DOCUMENTS

| | | | |
|---|---|---|---|
| 832300 | 1/1970 | Canada | 414/705 |
| 1235804 | 3/1967 | Fed. Rep. of Germany | 414/705 |
| 1376656 | 9/1964 | France | 414/705 |
| 300559 | 9/1965 | Netherlands | 414/705 |
| 1181192 | 2/1970 | United Kingdom | 414/705 |

*Primary Examiner*—E. H. Eickholt
*Attorney, Agent, or Firm*—Robert E. Burns; Emmanuel J. Lobato; Bruce L. Adams

[57] ABSTRACT

A bucket assembly for earthmoving machines which is capable of side dumping as well, and comprises a bucket, a bucket support and a hydraulic cylinder mechanism having a cylinder and a rod and interposed between the bucket and the bucket support. The bucket includes a bucket body, a first receiving portion and a second receiving portion provided at opposite upper side portions of the rear surface of the bucket body, and a first support portion and a second support portion provided at opposite lower side portions of the rear surface of the bucket body and having a first pivot pin and a second pivot pin extending nearly at right angles to the widthwise direction of the bucket body. The bucket support comprises a support body to be mounted on lift arms and tilt links of an earthmoving machine, a first supporting portion and a second supporting portion provided in the support body for receiving the first and second support portions of the bucket respectively from above and supporting them therein. The support further utilizing first and second pivotable hook members movable by power transmission members between operative and inoperative positions. The power transmissions members being pivotably connected selectively at one end to either the second or first receiving portion of the bucket and at the other end to a pivot member mounted on the support body.

8 Claims, 10 Drawing Figures

BUCKET ASSEMBLY FOR EARTHMOVING MACHINES CAPABLE OF SIDE DUMPING AS WELL

FIELD OF THE INVENTION

This invention relates to a bucket assembly for earthmoving machines, an more specifically, to a bucket assembly for earthmoving machines which is capable of side dumping as well.

DESCRIPTION OF THE PRIOR ART

When an earthmoving operation is performed in a tunnel or a like working site by an earthmoving machine equipped with a bucket assembly, it is often desired to discharge soil, sand, etc. in the bucket sideways instead of dumping them forward as in normal cases.

To meet this desire, a so-called threeway bucket assembly capable of performing dumping not only forward but also to the left or to the right as required has previously been proposed and gained practical acceptance. The conventional three-way bucket assembly is made up of a bucket support to be mounted on lift arms and tilt links of an earth-moving machine, a bucket supported on the bucket support through a pair of detachable pivot pins disposed at opposite side portions thereof, and a hydraulic cylinder mechanism interposed between the bucket support and the bucket. When only forward dumping is desired in such a bucket assembly, both of the pivot pins are used to connect the bucket to the bucket support for supporting. When left side or right side dumping is desired, either the right side or left side pivot pin in the aforesaid pair is detached, and the bucket is connected to the bucket support only by the left side or right side pivot pin. When in this state, the hydraulic cylinder mechanism is stretched, the bucket is turned to a left side or right side dumping position about the left side or right side pivot pin as a center, and when the hydraulic cylinder mechanism is contracted, the bucket is returned to the original operating or loading position.

The bucket assembly described above can perform not only forward dumping, but also left side or right side dumping as required, and can therefore be used conveniently in a wide range of working sites. However, it has the following defects or problems. In setting the bucket assembly in condition for left side or right side dumping, the right side or left side pivot pin is detached and the bucket is connected to the bucket support only by the left side or right side pivot pin. Thus, the bucket assembly performs excavating and loading operations in this state. Consequently, the bucket is not accurately supported by the bucket support, and sufficient safety cannot be secured. Furthermore, the load exerted on the bucket at the time of operation is concentrated on the left side or right side pivot pin and related constituent elements, and a localized high stress acts not only on the bucket assembly but also on the lift arms of the earthmoving machine and adversely affects the durability of these parts.

As a three-way bucket assembly free from the aforesaid defects or problems, Japanese Patent Publication No. 47241/1977 discloses a bucket assembly in which an engaging means of a unique structure is used to connect a bucket to a bucket support and a double rod-type hydraulic cylinder mechanism is interposed between the bucket and the bucket support. As stated in detail in the specification of the above-cited Patent Publication, the aforesaid defects are skillfully remedied in the bucket assembly disclosed therein, and it also has the advantage that left side or right side dumping can be performed as desired only by suitably controlling the double rod-type hydraulic cylinder mechanism without the need for any manual operation such as the detachment of pivot pins. However, since the engaging means used to connect the bucket to the bucket support is much complicated in structure, this bucket assembly has the defect of requiring a considerably high cost of production.

Furthermore, in any of the aforesaid known bucket assemblies, the rotating inertia of the bucket, which occurs corresponding to the speed of stretching the hydraulic cylinder mechanism when the hydraulic cylinder mechanism is stretched to pivot the bucket to a side dumping position, changes to a large force of impact upon stopping of the stretching of the hydraulic cylinder mechanism. This force of impact causes considerable vibration and noises in the bucket assembly or the lift arms of the earthmoving machine, and may sometimes lead to damaging of the bucket assembly or the lift arms.

SUMMARY OF THE INVENTION

It is an object of this invention to provide a novel and excellent bucket assembly in which a bucket is accurately supported by a bucket support at both side portions thereof during an excavating or loading operation without the need for a very complex engaging means or the like and therefore without markedly increasing the cost of production, and in which sufficient safety and durability can be secured.

Another object of this invention is to provide a novel and excellent bucket assembly in which when a bucket is turned to a side dumping position by stretching a hydraulic cylinder mechanism, a force of impact which occurs upon stopping of the stretching of the hydraulic cylinder owing to an inertia of rotation of the bucket corresponding to the speed of stretching of the hydraulic cylinder mechanism is elastically absorbed by a spring member.

According to this invention, there is provided a bucket assembly for earthmoving machines which is capable of side dumping as well and comprises a bucket, a bucket support and a hydraulic cylinder mechanism having a cylinder and a rod and interposed between the bucket and the bucket support, characterized in that the bucket includes a bucket body, a first receiving portion and a second receiving portion provided at opposite upper side portions of the rear surface of the bucket body, and a first support portion and a second support portion provided at opposite lower side portions of the rear surface of the bucket body and having a first pivot pin and a second pivot pin extending nearly at right angles to the widthwise direction of the bucket body;

in that the bucket support comprises a support body to be mounted on lift arms and tilt links of an earthmoving machine, a first supporting portion and a second supporting portion provided in the support body for receiving the first and second support portions of the bucket respectively from above and supporting them therein, a first hook member and a second hook member mounted such that they pivot between an operating position at which they respectively come into engagement with the first and second support portions of the bucket to hold the first and second support portions in the first and second supporting portions and an inoperative position at which they move away from the first and second support portions of the bucket respectively, a pivot member pivotably mounted on the support body, a first stop surface and a second stop surface for restricting the pivotal movement of the pivot member within a predetermined range, a first power transmission member having one end connected to the first hook member and the other end selectively connected to the pivot member or the support body, and a second power transmission member having one end connected to the second hook member and the other end selectively connected to the support body or the pivot member; and in that one of the cylinder and the rod of the hydraulic cylinder mechanism is pivotably connected selectively to either the second or first receiving portion of the bucket, and the other is pivotably connected to the pivot member.

Other objects of this invention will become apparent from the following description.

DETAILED DESCRIPTION OF PREFERRED EMBODIMENTS

The bucket assembly of this invention is described in detail below with reference to the accompanying drawings showing its preferred embodiments.

Figure 1:
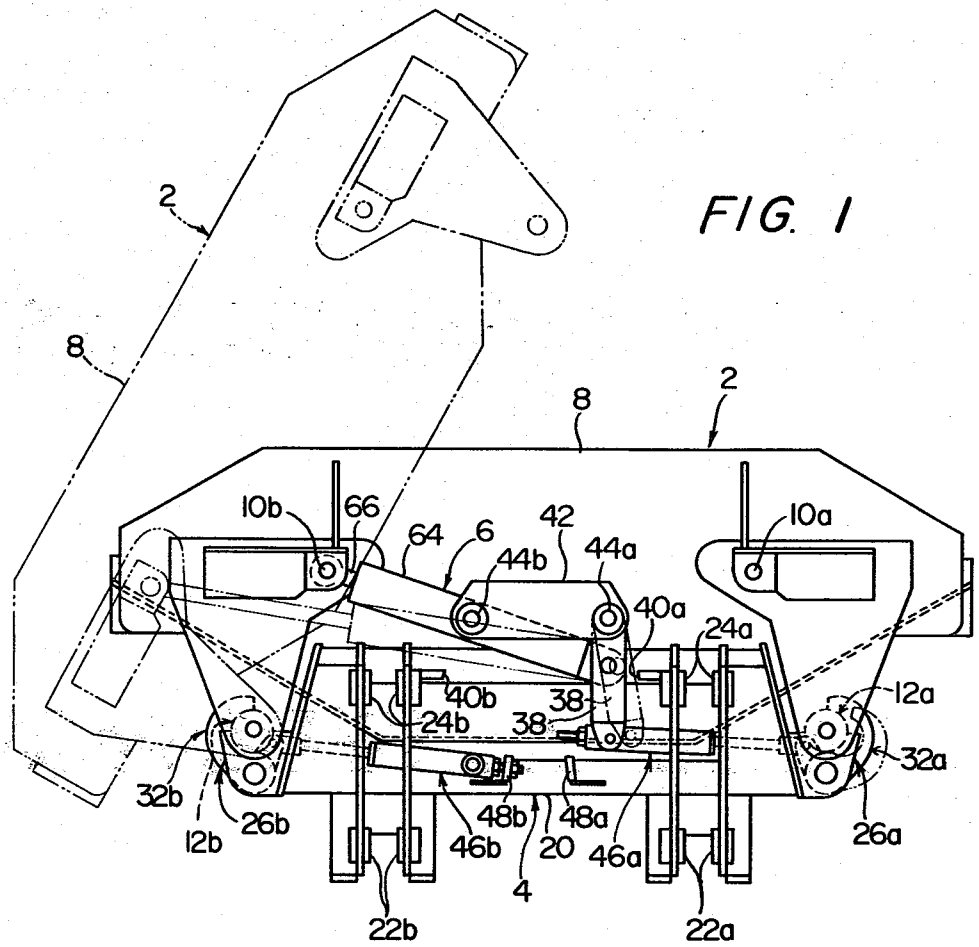
FIG. 1 is a rear view of a first embodiment of the bucket assembly in accordance with this invention.
Figure 2:
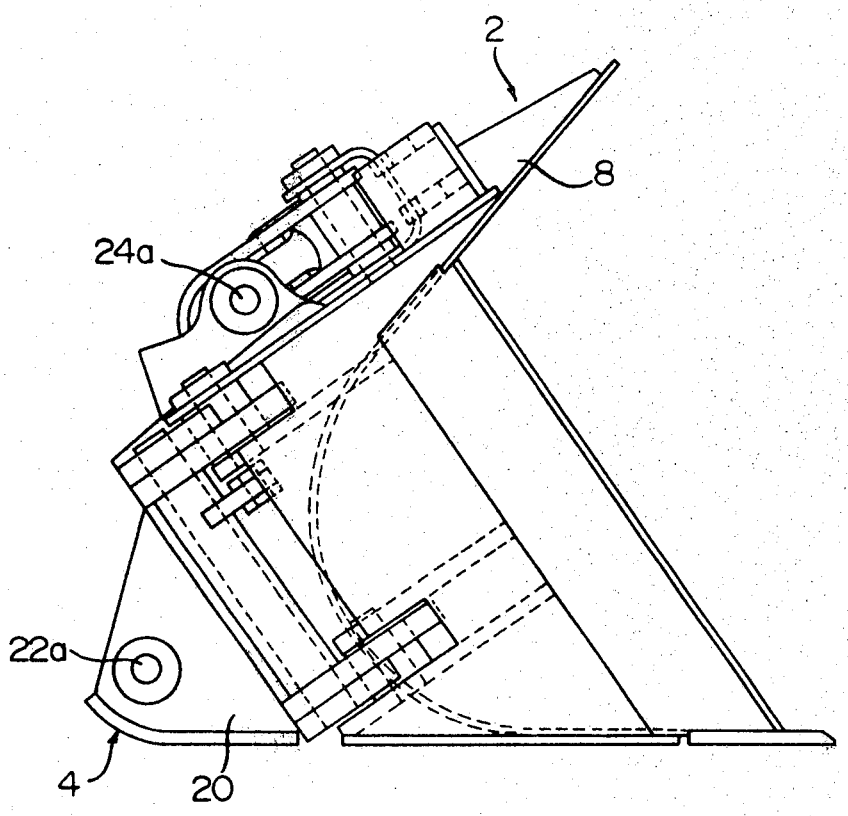
FIG. 2 is a side view of the bucket assembly shown in FIG. 1.

Referring to FIGS. 1 and 2, the illustrated bucket assembly is made up of a bucket 2, a bucket support 4 and a hydraulic cylinder mechanism 6 interposed between the bucket 2 and the bucket support 4.

Figure 4:
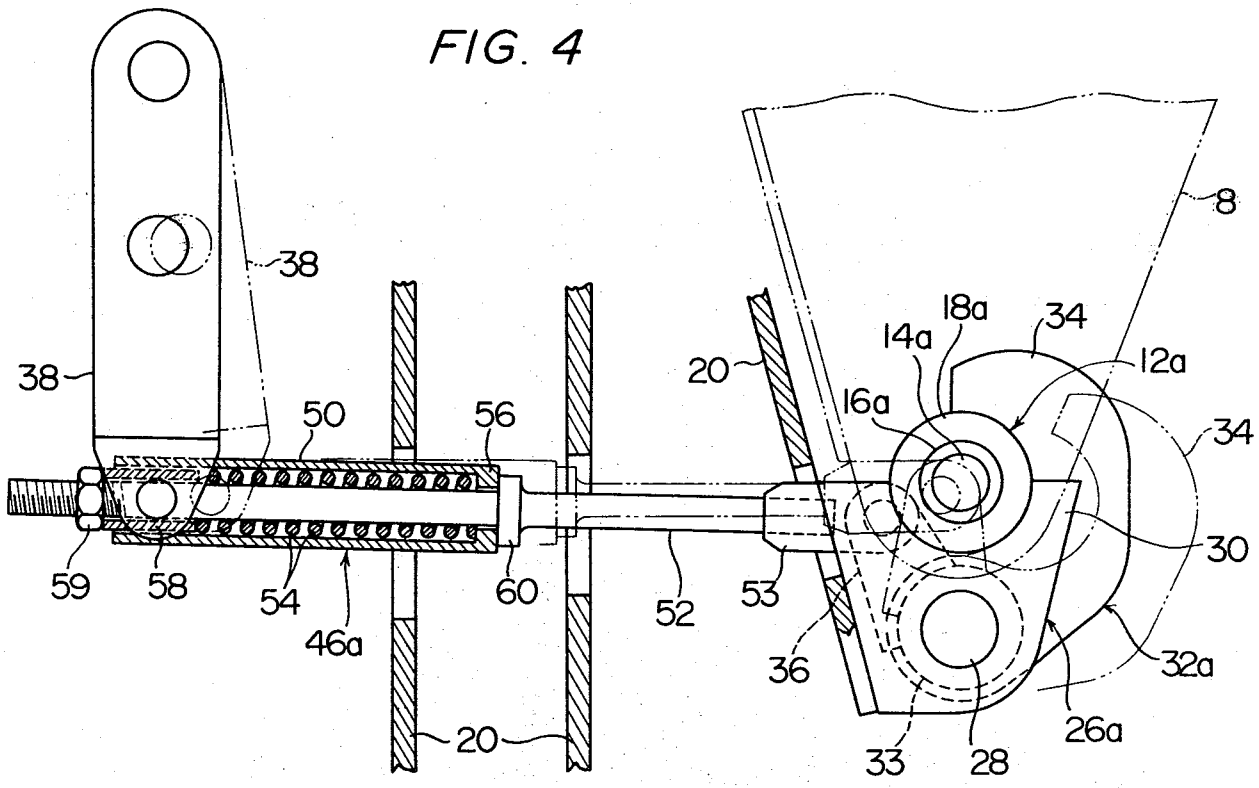
FIGS. 4 and 5 are partial sectional views showing details of a pivot member, power transmission members and hool members in the bucket assembly shown in FIG. 1.
Figure 5:
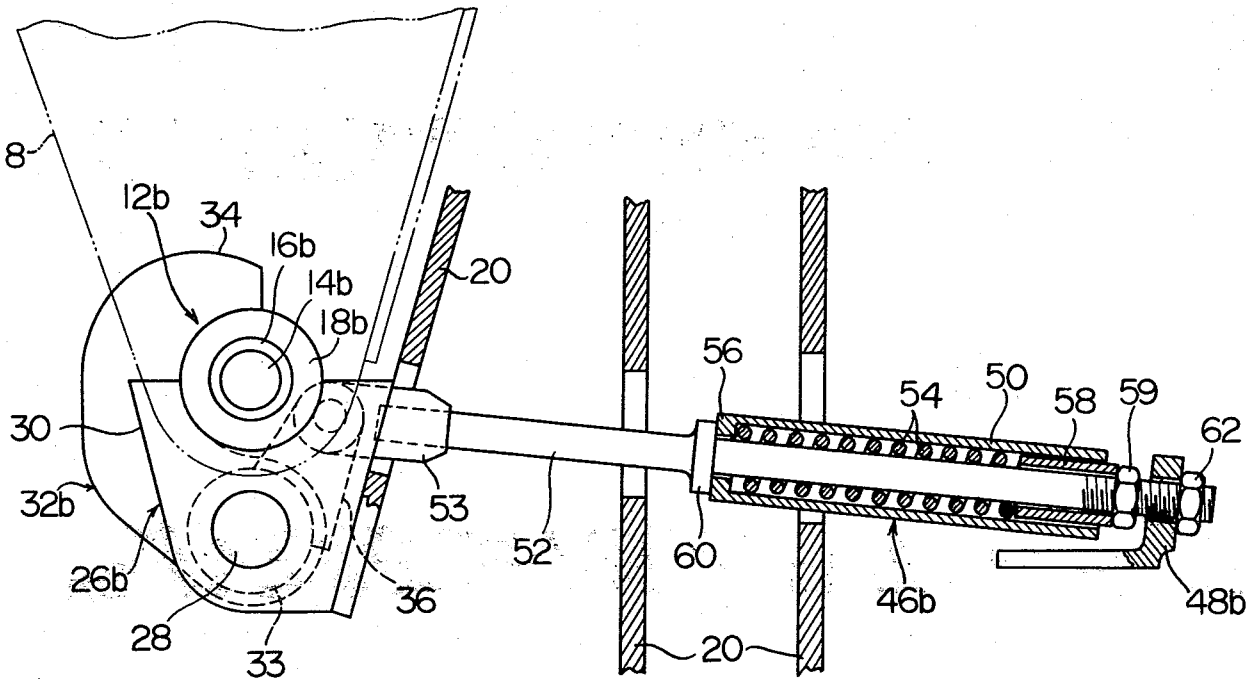

The bucket 2 is equipped with a bucket body 8 which may be of a shape suitable for such operations as excavation and loading and for dumping the load forward and sideways. At opposite side portions on the upper portion of the rear surface of the bucket body 8 are provided respectively a first receiving portion 10*a* and a second receiving portion 10*b* to which the hydraulic cylinder mechanism 6 is to be selectively connected, as will be described hereinbelow. At opposite side portions of the lower part of the rear surface of the bucket body 8 are respectively provided a first support portion 12*a* and a second support portion 12*b*. The first support portion 12*a*, as clearly illustrated in FIGS. 3 and 4, has at least one first pivot pin 14*a* fixed in position at the right side portion of the lower part of the bucket body 8 (in the illustrated embodiments, two pivot pins 14*a* are arranged longitudinally in spaced-apart relationship). The first pivot pin 14*a* constitutes a center of pivoting when turning the bucket body 8 to a right side dumping position, as will be described hereinbelow. It is important that the pivot pin 14*a* should be disposed so as to extend in a direction substantially perpendicular to the widthwise direction of the bucket body 8. Preferably, a first roller 18*a* is rotatably fitted over the first pivot pin 14*a* through a suitable bearing member 16*a*. The second support portion 12*a* clearly illustrated in FIG. 5 is of substantially the same construction as the first support portion 12*a*, and has at least one second pivot pin 14*b* (in the illustrated embodiment, two pivot pins 14*b* are disposed longitudinally in spaced-apart relationship) which is fixed in position at the left side portion of the lower part of the rear surface of the bucket body 8 and constitutes a center of pivoting when turning the bucket body 8 to a left side dumping position. Preferably, a second roller 18*b* is fitted over the second pivot pin 14*b* through a suitable bearing member 16*b*.

Figure 3:
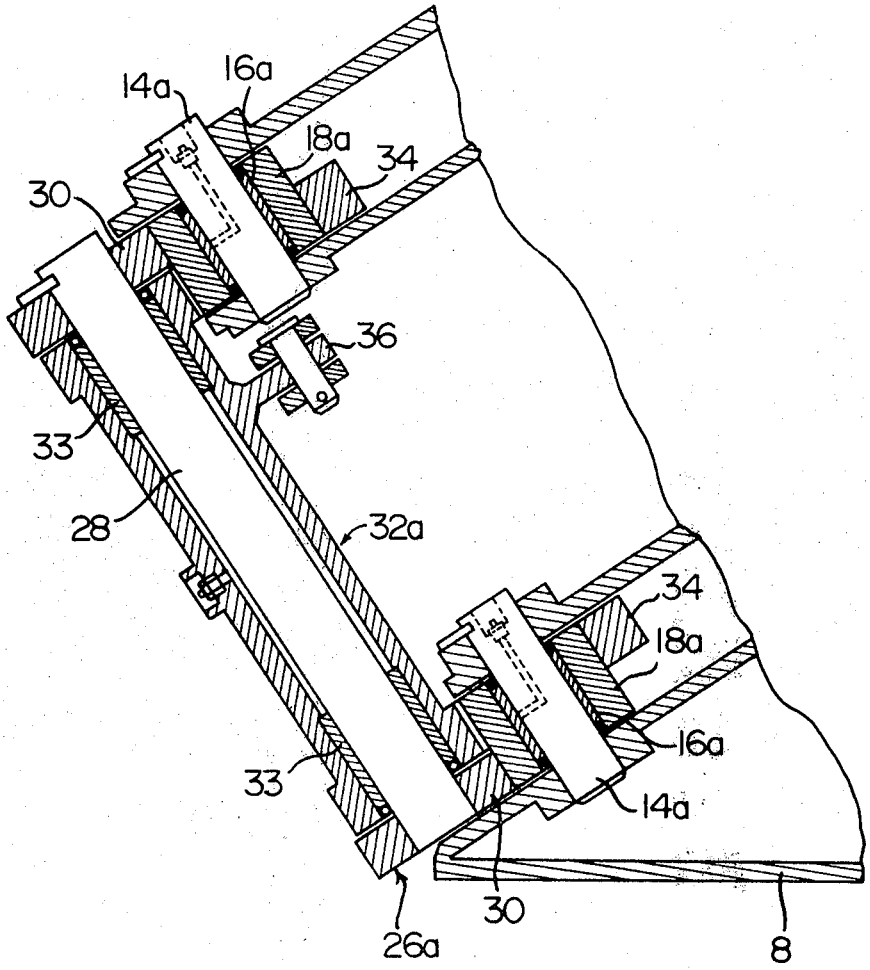
FIG. 3 is a partial sectional view showing details of support portions, supporting portions and hook members in the bucket assembly shown in FIG. 1.

The bucket support 4 is provided with a support body 20 which is mounted onto an earthmoving machine by connecting its sites 22*a* and 22*b* pivotably to the ends of a pair of lift arms (not shown) of the earthmoving machine and its sites 24*a* and 24*b* pivotably to the ends of a pair of tilt links (not shown) of the earthmoving machine. The support body 20 includes a first supporting portion 26*a* and a second supporting portion 26*b* which respectively receive the first support portion 12*a* and the second support portion 12*b* of the bucket 2 from above and support them therein. Each of the first supporting portion 26*a* and the second supporting portions 26*b*, as will be readily appreciated from FIGS. 1 to 5, especially from FIGS. 3 to 5, is composed of a pair of support pieces 30 secured to shaft members 28 fixed to the opposite side portions of the support body 20 and having an upwardly opened substantially semicircular supporting surface for receiving the first roller 18*a* (or the second roller 18*b*) from above and supporting it therein.

The support body 20 further has mounted thereto a first hook member 32*a* and a second hook member 32*b* which are provided respectively adjacent the first supporting portion 26*a* and the second supporting portion 26*b* in such a manner that they pivot between an operating position at which they come into engagement with the first support portion 12*a* and the second support portion 12*b* respectively and an inoperative position at which they are disengaged therefrom. In the illustrated embodiment, as can be easily appreciated from FIGS. 1 to 5, especially from FIGS. 3 to 5, the first hook member 32*a* and the second hook member 32*b* are rotatably mounted on the shaft members 28 fixed at both side portions of the support body 20 through a suitable bearing member. Each of the first hook member 32*a* and the second hook member 32*b* has a hook piece 34 which comes into engagement with each of the first roller 18*a* of the first support portion 12*a* and the second roller 18*b* of the second support portion 12*b* when it is at an operating position shown by the solid line (and broken line) in FIGS. 1, 4 and 5, and is disengaged therefrom when it is brought to an inoperative position shown by the two-dot chain line in the right-hand side of FIG. 1 and in FIG. 4. Furthermore, each of the first hook member 32*a* and the second hook member 32*b* has a connecting projection 36 to which a power transmission member to be described is to be connected.

The bucket support 4 also includes a pivot member 38 pivotably mounted on the support body 20 and a first stop surface 40*a* and a second stop surface 40*b* for restricting the pivoting of the pivot member 38 within a predetermined range. In the illustrated embodiment, a bracket 42 is fixed to the support body 20 centrally at its upper portion, and to either one of a pair of fixing positions 44*a* and 44*b* defined at opposite side portions of the bracket 42 is pivotably mounted the upper end of the pivot member 38 made of an elongated plate-like piece. In the state illustrated in FIGS. 1 and 4, the upper end of the pivot member 38 is pivotably mounted to the right-hand fixing position 44*a* of the bracket 42. The first stop surface 40*a* is constructed of the surface of a suitable piece fixed to the support body 20, and is adapted to abut the pivot member 38 to restrict its pivotal movement when the pivot member is turned counterclockwise in FIG. 1 as shown by the two-dot chain line in FIGS. 1 and 4 while the upper end of the pivot member 38 is mounted to the right fixing position 44*a* of the bracket 42. Likewise, the second stop surface 40*b* constructed of the surface of a suitable piece fixed to the support body 20 is adapted to abut the pivot member 38 to restrict its pivotal movement when the pivot member 38 is turned clockwise in FIG. 1 while the upper end of the pivot member 38 is mounted to the left fixing position 44*b* of the bracket 42 (this state occurs, as will be described hereinbelow, when turning the bucket 2 to a right side dumping position).

The bucket support 4 further includes a first power transmission member 46*a* and a second power transmission member 46*b*. One end of the first power transmission member 46*a* is connected pivotably to the first hook member 32*b*, or more specifically to the connecting projection 36 thereof, and the other is selectively secured to either one of the pivot member 38 or a predetermined position of the support body 20 (a transmission member fixing part 48*a* provided in the support body 20). In the illustrated embodiment, the aforesaid other end of the first power transmission member 46*a* is connected to the lower end of the pivot member 38. On the other hand, one end of the second power transmission member 46*b* is pivotably connected to the second hook member 32*b*, or more specifically to the connecting projection 36 thereof, and the other is selectively connected to either one of a predetermined position (a power transmission member fixing part 48*b* provided in the support 20) or to the lower end of the pivot member 38. In the illustrated embodiment, the aforesaid other end of the second power transmission member 46*b* is connected to the predetermined position, i.e. the fixing part 48*b*, of the support body 20.

The first and second power transmission members 46*a* and 46*b* may be of any desired construction so long as they can perform the desired function. Preferably, they are of the form shown in FIGS. 4 and 5. Referring to FIGS. 4 and 5, each of the first and second power transmission member 46*a* and 46*b* includes a cylindrical member 50, a rod 52 extending therethrough, and a spring member 54 disposed in the cylindrical member 50. In FIG. 4, an annular flange 56 projecting radially inwardly is formed at the right end of the cylindrical member 50, and a sleeve piece 58 is put over the left end portion of the rod 52. A nut 59 is clamped over the rod 52 on the left side of the sleeve piece 58. The spring member 54 composed of a coil spring is disposed between the annular flange 56 and the sleeve piece 58. The spring member 54 is adapted to bias the rod 52 elastically to the left in FIG. 4 with respect to the cylindrical member 50. On the other hand, a stopping piece 60 formed of an annular flange projecting radially outwardly is provided in an intermediate portion of the rod 52 which is to the right of the right end of the cylindrical member 50. The stopping piece 60 restricts the left relative movement of the rod 52 with respect to the cylindrical member 50 by coming into abutment with the right end of the cylindrical member 50. In the first and second power transmission members 46*a* and 46*b* having the form as described above, a connecting piece 53 is fixed to one end of the rod 52. The connecting piece 53 is pivotably connected to the connecting projection 36 of each of the first and second hook members 32*a* and 32*b*. On the other hand, when the first (or second) power transmission member 46*a* (or 46*b*) is to be connected to the pivot member 38, one end portion (the left end portion in FIG. 4) of the cylindrical member 50 is pivotably connected to the lower end of the pivot member 38, and the other end (i.e., the left end in FIG. 4) is maintained free, as shown in FIG. 4. In such a case, as will be readily understood from FIG. 4, the lower end of the pivot member 38 is connected to the connecting projection 36 of the first (or second) hook member 32*a* through the first (or second) power transmission member 46*a* (or 46*b*), and as will be described in detail hereinbelow, the first (or second) hook member 32*a* is pivoted according to the pivoting of the pivot member 38. When the second (or first) power transmission member 46*b* (or 46*a*) is to be connected to the fixing portion 48*b* (or 48*a*) of the support body 20, the other end (the right end in FIG. 5) of the rod 52 is fixed to the fixing portion 48*b* (or 48*a*) by a nut 62, as shown in FIG. 5. In this case, the connecting projection 36 of the second (or first) hook member 32*b* (or 32*a*) is consequently fixed directly to the support body 20 through the rod 52, and the second (or first) hook member 32*b* (or 32*a*) is held at the operating position, as shown in FIG. 5. The cylindrical member 50 and the spring member 54 of the second (or first) power transmission member 46*b* (or 46*a*) are in the idle state.

Now, the hydraulic cylinder mechanism 6 is described. In the embodiment shown in FIG. 1, the hydraulic cylinder mechanism 6 is a one-rod type including a cylinder 64, and a single rod 66 slidable with respect to the cylinder 64 and projecting from one end of the cylinder. The so-called head end side of the cylinder 64 is pivotably connected to an intermediate part of the pivot member 38, and the forward end of the rod 66 is pivotably connected to either one of the first receiving portion 10*a* and the second receiving portion 10*b* provided at the opposite upper side portions of the rear surface of the bucket body 8 (to the second receiving portion 10*b* in the illustrated embodiment).

The operation and effect of the bucket assembly constructed in accordance with this invention are described.

It should be understood in this regard that the illustrated bucket assembly is set in a condition which can permit left side dumping (the setting of the bucket assembly in a condition which can permit right side dumping will be described hereinbelow).

The bucket assembly is maintained in a condition shown by the solid line in FIG. 1 when performing such operations as excavating or loading or performing forward dumping. In this condition, the first and second support portions 12*a* and 12*b* provided in the bucket 2 are respectively received and supported in the first and second supporting portions 26*a* and 26*b* provided in the bucket support 4. In addition, the first and second hook members 32*a* and 32*b* provided in the bucket support 4 are at the operating positions and are respectively engaged with the first and second support portions 12*a* and 12*b* provided in the bucket 2. More specifically, the hook pieces 34 of the first and second hook members 32*a* and 32*b* are respectively engaged with the first roller 18*a* of the first support portion 12*a* and the second roller 18*b* of the second support portion 12*b*. Thus, the bucket 2 is connected to, and accurately supported by, the bucket support 4 at its both side portions.

When soil, sand, etc. loaded in the bucket 2 are to be dumped to the left side, the hydraulic cylinder mechanism 6 is stretched by the action of a suitable hydraulic circuit (not shown). As a result, first the pivot member 38 provided in the bucket support 4 is turned counterclockwise in FIGS. 1 and 4 from a position shown by the solid line in FIGS. 1 and 4. This pivot movement of the pivot member 38 is restricted by the abutting of the pivot member 38 with the first stop surface 40*a*, and therefore, the pivot member 38 is turned to a position shown by the two-dot chain line in FIGS. 1 and 4. The pivotal movement of the pivot member 38 is transmitted to the first hook member 32*a* through the first power transmission member 46*a*, or more specifically through the cylindrical member 50, the right end of the cylindrical member 50, the stopping piece 60 formed in the rod 52 and the rod member 52 (in this case, not through the spring member 54), to move the first power transmission member 46*a* to a position shown by the two-dot chain line in FIG. 4. Simultaneously, the first hook member 32*a* is brought to an inoperative position shown by the two-dot chain line in FIGS. 1 and 4 whereby it is detached from the first support portion 12*a* (more specifically the hook piece 34 of the first hook member 32*a* is detached from the first roller 18*a* of the first support portion 12*a*).

When the hydraulic cylinder mechanism 6 is further stretched, the pivotal movement of the pivot member 38 is restricted by its abutment with the first stop surface 40*a*. At the same time, since the first hook member 32*a* is off from the first support portion 12*a*, the bucket 2 is turned counterclockwise in FIG. 1 about the second pivot pin 14*b* (FIG. 5) of the second support portion 12*b* as a center, and is thus brought to a left side dumping position shown by the two-dot chain line in FIG. 1. Thus, the soil, sand, etc. in the bucket 2 are dumped to the left.

When the dumping of the soil, sand, etc. is over, the hydraulic cylinder mechanism 6 is contracted. As a result, first, the bucket 2 at the left side dumping position (i.e., the position shown by the two-dot chain line in FIG. 1) is turned clockwise about the second pivot pin 14*b* (FIG. 5) of the second support portion 12*b* as a center and returned to the original position shown by the solid line in FIG. 1. When the hydraulic cylinder mechanism 6 is further contracted, the pivot member 38 at a position at which it abuts the first stop surface 40*a* (i.e., the position shown by the two-dot chain line in FIG. 1) is turned clockwise in FIGS. 1 and 4 and returned to a position shown by the solid line in FIGS. 1 and 4. This pivotal movement of the pivot member 38 is transmitted to the first hook member 32*a* through the first power transmission member 46*a*, or more specifically through the cylindrical member 50, the annular flange 56 provided at the right end of the cylindrical member 50, the spring member 54, the sleeve piece 58 fitted over the rod 52, the nut 59 clamped at the rod 52 and the rod 52, to return the first power transmission member 46*a* to a position shown by the solid line in FIGS. 1 and 4 and return the first hook member 32*a* to the operating position shown by the solid line in FIGS. 1 and 4. Thus, the first hook member 32*a* again comes into engagement with the first support portion 12*a* (more specifically, the hook piece 34 of the first hook member 32*a* again comes into engagement with the first roller 18*a* of the first support portion 12*a*).

Now, the advantages obtained by using the first (or second) power transmission member 46*a* (or 46*b*) including the spring member 54 as shown in FIGS. 4 and 5 are described.

Figure 6:
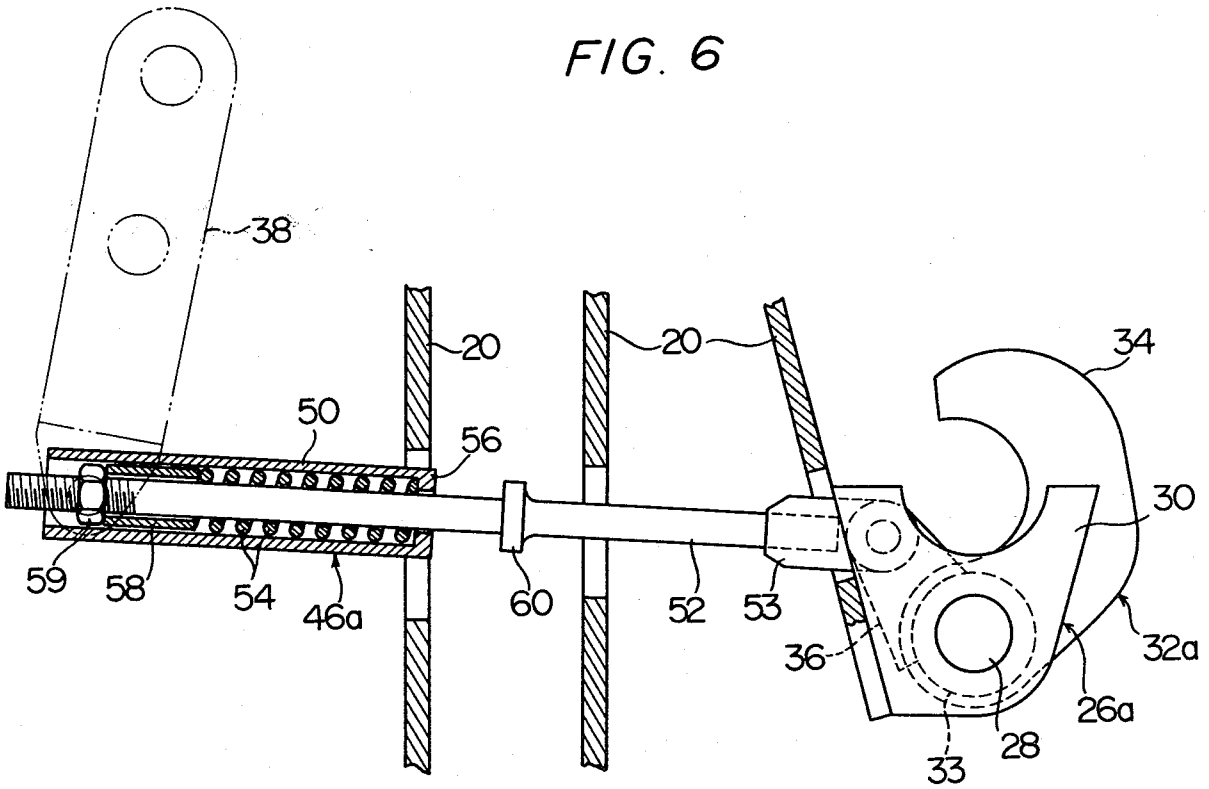
FIGS. 6 and 7 are partial sectional views for illustrating the advantages brought about by the power transmission members in the bucket assembly shown in FIG. 1.

Firstly, when the hydraulic cylinder mechanism 6 is stretched to turn the bucket 2 to the left side dumping position shown by the two-dot chain line in FIG. 1, a considerable force of impact corresponding to the speed of stretching the hydraulic cylinder mechanism 6 is generated owing to an inertia of rotation of the bucket 2 upon stopping the stretching of the hydraulic cylinder mechanism 6. Because of this force of impact, a considerable pulling force is exerted on the pivot member 38, the first power transmission member 46*a* and the first hook member 32*a*. Thus, as shown in FIG. 6, the pivot member 38 is pivoted clockwise in FIG. 6, and therefore, the first hook member 32*a* is turned counterclockwise in FIG. 6. But the counterclockwise turning of the first hook member 32*a* in FIG. 6 is restricted by the abutment of the connecting projection 36 of the first hook member 32*a* against the support body 20 as illustrated in FIG. 6. When the aforesaid force of impact is considerably large and the pulling force exerted on the pivot member 38, the first power transmission member 46*a* and the first hook member 32*a* is large, after the connecting projection 36 of the first hook member 32*a* has abutted the support body 20, only the cylindrical member 50 of the first power transmission member 46*a* is moved to the left in FIG. 6 according to the clockwise turning of the pivot member 38 in FIG. 6 while the rod 52 of the first power transmission member 46*a* and the first hook member 32*a* remain stationary. Accordingly, as illustrated in FIG. 6, the spring member 54 of the first power transmission member 46*a* is compressed. In this manner, the increased impact and pulling forces are elastically absorbed by the compression of the spring member 54 to accurately prevent considerable vibration and noises and the damage of the bucket assembly or lift arms of the earthmoving machine, which are ascribed to these impact and pulling forces. When the above impact and pulling forces which are generated temporarily have disappeared, the pivot member 38, the first power transmission member 46*a* and the first hook member 32*a* return to the state shown by the two-dot chain line in FIG. 4.

Figure 7:
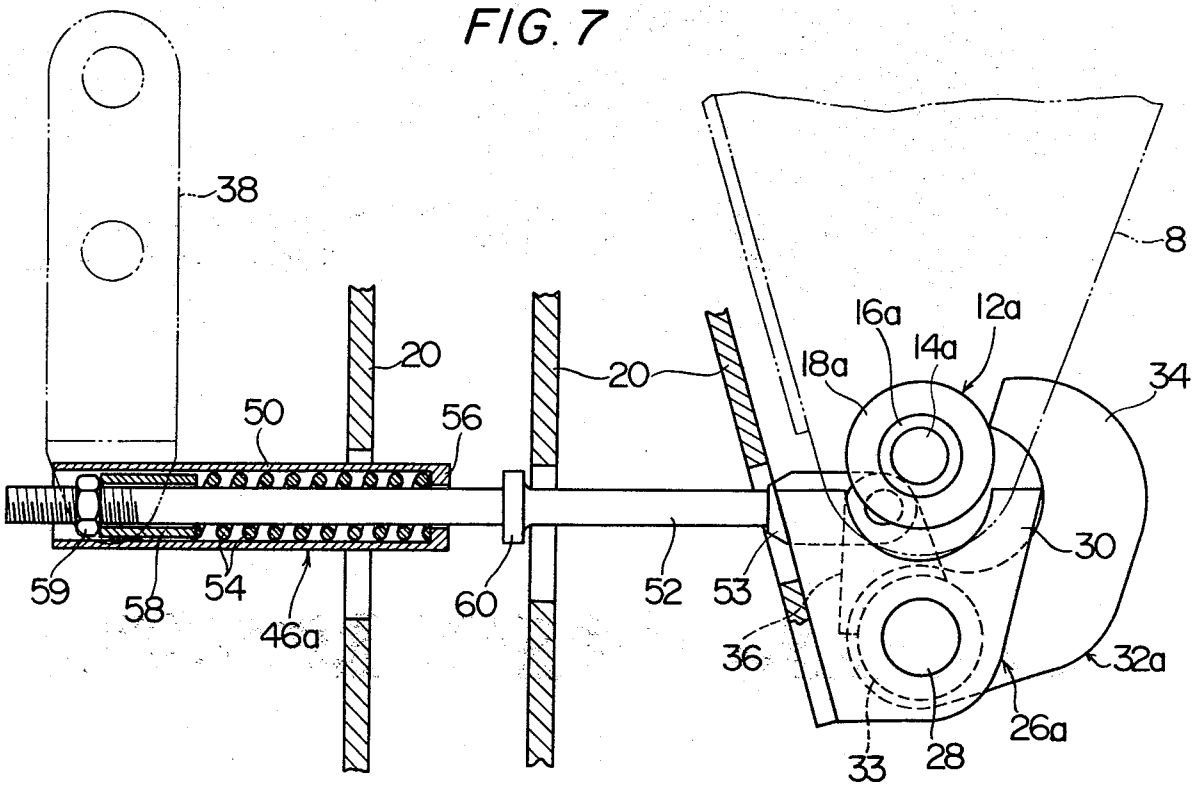

Secondly, a trouble may occur when it is desired to return the bucket 2 at the left side dumping position shown by the two-dot chain line in FIG. 1 by turning it clockwise in FIG. 1 and then to bring the first hook member 32 to the operative position shown by the solid line in FIG. 4 by turning it counterclockwise in FIG. 4 from the inoperative position shown by the two-dot chain line in FIG. 4. For example, when soil, sand, etc. get into the space between the supporting piece 30 of the first supporting position 26*a* and the first roller 18*a* of the first support portion 12*a* or between the first roller 18*a* of the first support portion 12*a* and the hook piece 34 of the first hook member 32*a*, it is impossible to engage the first hook member 32*a* with the first support portion 12*a* (more specifically, to engage the hook piece 34 of the first hook member 32*a* with the first roller 18*a* of the first support portion 12*a*). If an attempt is made to engage the first hook member 32*a* with the first support portion 12*a* without removing the soil, sand, etc., an excessive force is imparted by the hydraulic cylinder mechanism 6 to the pivot member 38, the first power transmission member 46*a*, the first hook member 32*a* and the first support member 12*a*, and these component parts might be damaged. When, however, the first power transmission member 46*a* containing the spring member 54 illustrated in FIG. 4 is used, in the event that the first hook member 32*a* cannot be engaged with the first support member 12*a* for some reason, the spring member 54 is compressed by the force imparted by the hydraulic cylinder mechanism 6 (namely, the cylindrical member 50 is moved to the left in FIG. 7 relative to the rod 52), and the excessive force imparted by the hydraulic cylinder mechanism 6 is elastically absorbed by the compression of the spring member 54. Accordingly, such component parts as the pivot member 38, the first power transmission member 46*a*, the first hook member 32*a* and the first support member 12*a* can be accurately prevented from being damaged.

The elastic strength of the spring member 54 in the first (or second) power transmission member 46*a* (or 46*b*) which brings about the excellent advantages mentioned above can be adjusted by manipulating the nut 59 and thereby changing the position of the sleeve piece 58 with respect to the stop piece 60.

In the states illustrated in FIGS. 1 to 7, the bucket assembly of the invention is set in a condition which can permit the bucket 2 to reach the left side dumping position. In order to set the bucket assembly in a condition which can permit the bucket 2 to move to a right side dumping position, the following operations should be performed.

(1) release the connection of the aforesaid other end of the first power transmission member 46*a* to the pivot member 38 (namely, release the connection of the cylindrical member 50 of the first power transmission member 46*a* to the pivot member 38).

(2) Connect the aforesaid other end of the first power transmission member 46*a* to a predetermined position of the support body 20 (namely, fix the free end of the rod 52 of the first power transmission member 46*a* to the first power transmission member fixing portion 48*a* of the support body 20).

(3) Release the connection of the hydraulic cylinder mechanism 6 to the second receiving portion 10*b* of the bucket 2, and simultaneously, release the connection of the hydraulic cylinder mechanism 6 to the pivot member to remove the hydraulic cylinder mechanism 6.

(4) Release the connection of the right-side fixing position 44*a* of the bracket 42 to the upper end of the pivot member 38 to remove the pivot member 38.

(5) Connect the upper end of the pivot member 38 pivotably to the left-side fixing position 44*b* of the bracket 42.

(6) Connect the heat-side end portion of the cylinder 64 of the hydraulic cylinder mechanism 6 pivotably to an intermediate part of the pivot member 38, and also connect the forward end of the rod 66 of the hydraulic cylinder mechanism to the first receiving portion 10*a* of the bucket 2.

(7) Release the connection of the aforesaid other end of the second power transmission member 46*b* to a predetermined position of the support body 20 (namely, detach the right end of the rod of the second power transmission member 46*b* from the second power transmission member fixing portion 48*b* of the support body 20).

(8) Connect the aforesaid other end of the second power transmission member 46*b* to the pivot member 38 (namely, connect the cylindrical member 50 of the second power transmission member 46*b* pivotably to the lower end of the pivot member 38).

By performing the above operations (1) to (8), the bucket assembly can be set in condition for bringing the bucket 2 to the right side dumping position. The operation and effect of the bucket assembly in this condition are substantially the same as those of the bucket assembly which is set in condition for bringing the bucket 2 to the left side dumping position.

Figure 8:
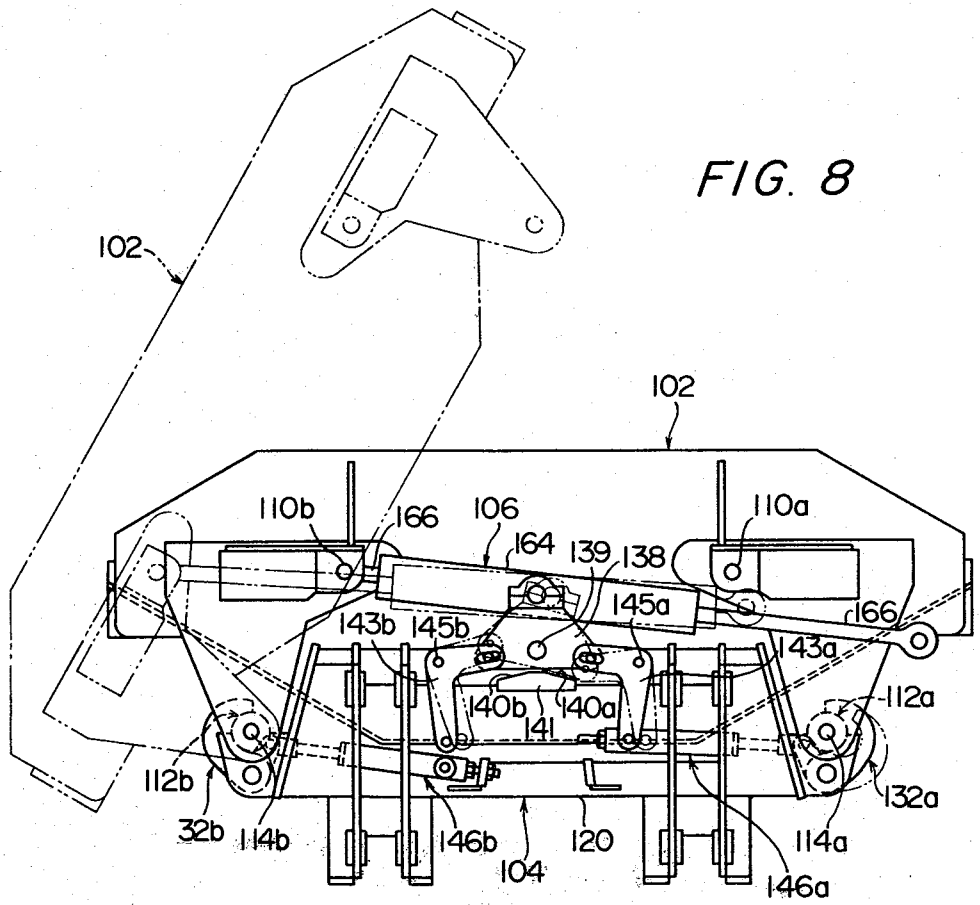
FIG. 8 is a rear view of a second embodiment of the bucket assembly in accordance with this invention.

A second embodiment of the bucket assembly constructed in accordance with this invention is illustrated in FIG. 8.

The second embodiment shown in FIG. 8 differs from the first embodiment shown in FIGS. 1 to 7 in the following respects.

In the second embodiment, a pivot member 138 in a bucket support 104 is made of a substantially triangular plate whose center is pivotably mounted to a support body 120. A first stop surface 140*a* and a second stop surface 140*b* which restrict the pivotal movement of the pivot member 138 within a predetermined range are formed of two tilted top edge surfaces of a piece 141 fixed to the support body 120 beneath, and in proximity to, the pivot member 138. Moreover, in the second embodiment, substantially L-shaped members 143*a* and 143*b* are disposed on opposite sides of the pivot member 138. The forward end of one arm portion of the L-shaped member 143*a* whose bended portion is pivotably mounted to the support body 120 by a pin 145*a* is connected to the right lower end portion of the pivot member 138 by an elongated slot and a pin. Likewise, the forward end of one arm portion of the L-shaped member 143*b* whose bended portion is pivotably mounted to the support body 120 by a pin 145*b* is connected to the left lower end portion of the pivot member 138 by an elongated slot and a pin. By connecting the aforesaid other end of a first power transmission member 146*a* pivotably to the forward end of the arm portion of the member 143*a* instead of connecting it directly to the pivot member 138, the other end of the first power transmission member 146*a* is connected pivotably to the pivot member 138 through the aforesaid member 143*a*.

Furthermore, in the second embodiment, a double rod-type hydraulic cylinder mechanism 106 composed of a cylinder 164 and rods 166 projecting respectively from the two ends of the cylinder is used. An intermediate part of the cylinder 164 is pivotably connected to the upper portion of the pivot member 138, and the left end of the rod 166 is pivotably connected to the second receiving portion 110*b* of the bucket 102.

The constructions of the second embodiment other than the above are the same as the constructions of the first embodiment.

In operation, when the rod 166 is projected to the left with respect to the cylinder 164 by controlling the hydraulic cylinder mechanism 106 in the state shown by the solid line in FIG. 8, first the pivot member 138 is turned clockwise in FIG. 8 and comes into abutment with a first stop surface 140*a* shown by the two-dot chain line in FIG. 8. This pivotal movement of the pivot member 138 is transmitted to a first hook member 132*a* through the member 143*a* and the first power transmission member 146*a*, whereby the first hook member 132*a* is turned to an inoperative position shown by the two-dot chain line from its operating position shown by the solid line in FIG. 8 and detached from a first support portion 112*a* provided in a bucket 102. Then, the bucket 102 is turned counterclockwise in FIG. 8 about a pivot pin 114 of a second support portion 112*b* as a center, and is thus brought to a left side dumping position shown by the two-dot chain line in FIG. 8.

When the rod 166 is moved to the right with respect to the cylinder 164 by controlling the hydraulic cylinder mechanism 106 in the state shown by the two-dot chain line in FIG. 8 at which the bucket 102 is at the left side dumping position, first the bucket 102 is turned clockwise in FIG. 8 about the pivot pin 114*b* of the second support portion 112*b* and returned to a position shown by the solid line. Then, the pivot member 138 is turned counterclockwise in FIG. 8 and returned to a position shown by the solid line. This pivotal movement of the pivot member 138 is transmitted to the first hook member 132*a* through the member 143*a* and the first power transmission member 146*a*, whereby the first hook member 132*a* is turned from the inoperative position shown by the two-dot chain line to the operating position shown by the solid line in FIG. 8, and thus, again comes into engagement with the first support portion 112*a* provided in the bucket 102.

When in the second embodiment illustrated in FIG. 8, it is desired to change the illustrated condition in which the bucket 102 can be brought to the left side dumping position to a state in which the bucket 102 can be brought to a right side dumping position, the following operations should be performed.

(1) Release the connection of the left end of the rod 166 in the hydraulic cylinder mechanism 106 to the second receiving portion 110*b*.

(2) Move the rod 166 of the hydraulic cylinder mechanism 106 to the left with respect to the cylinder 164 to set it in the condition shown by the two-dot chain line in FIG. 8, and thereafter connect the right end of the rod 166 pivotably to the first receiving portion 110*a*.

(3) Release the connection of the first power transmission member 146*a* to the member 143*a*.

(4) Connect the second power transmission member 146*b* pivotably to the member 143*b*.

By performing the operations (1) to (4), the bucket assembly is set in condition for bringing the bucket 102 to the right side dumping position. The operation and effect of the bucket assembly in this condition are substantially the same as those of the bucket assembly in a condition in which the bucket 102 can be brought to the left side dumping position.

Figure 9:
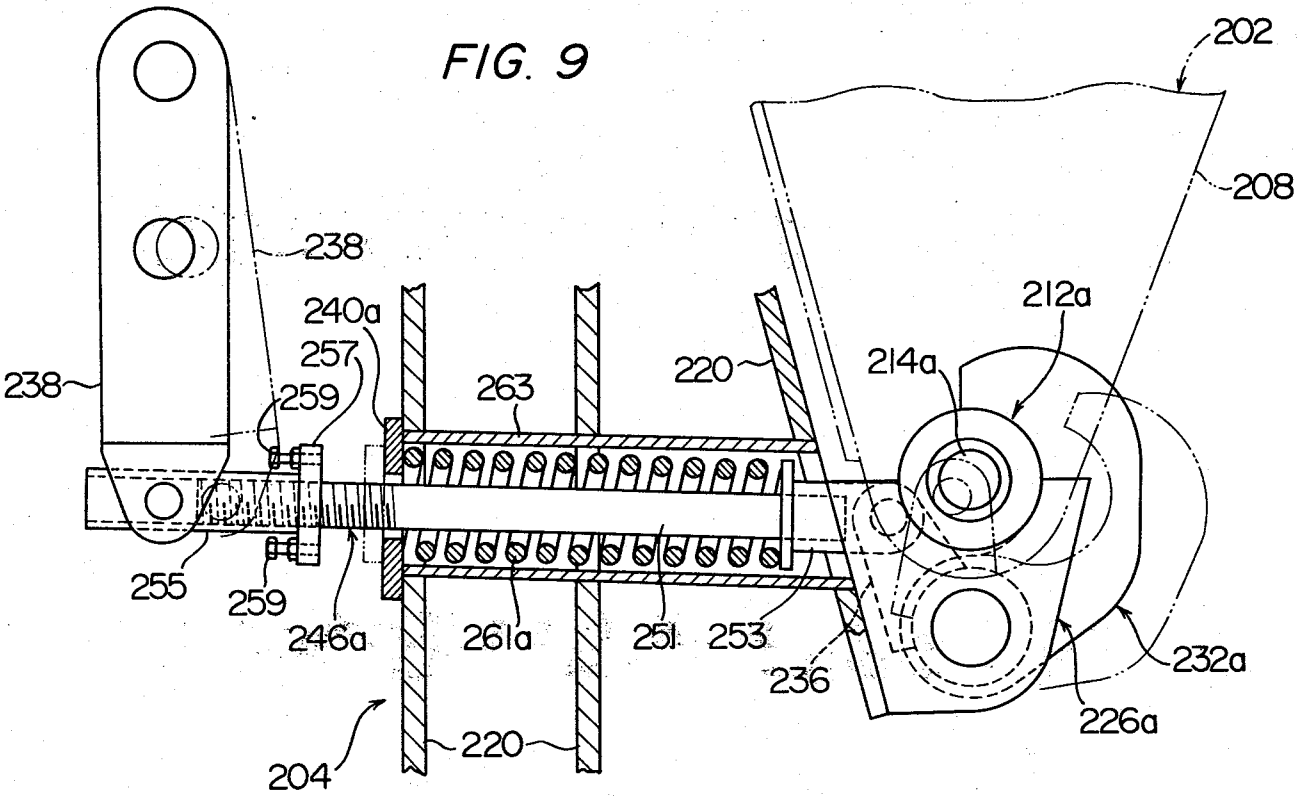
FIGS. 9 and 10 are partial sectional views showing details of a pivot member, power transmission members and hook members in a third embodiment of the bucket assembly in accordance with this invention.
Figure 10:
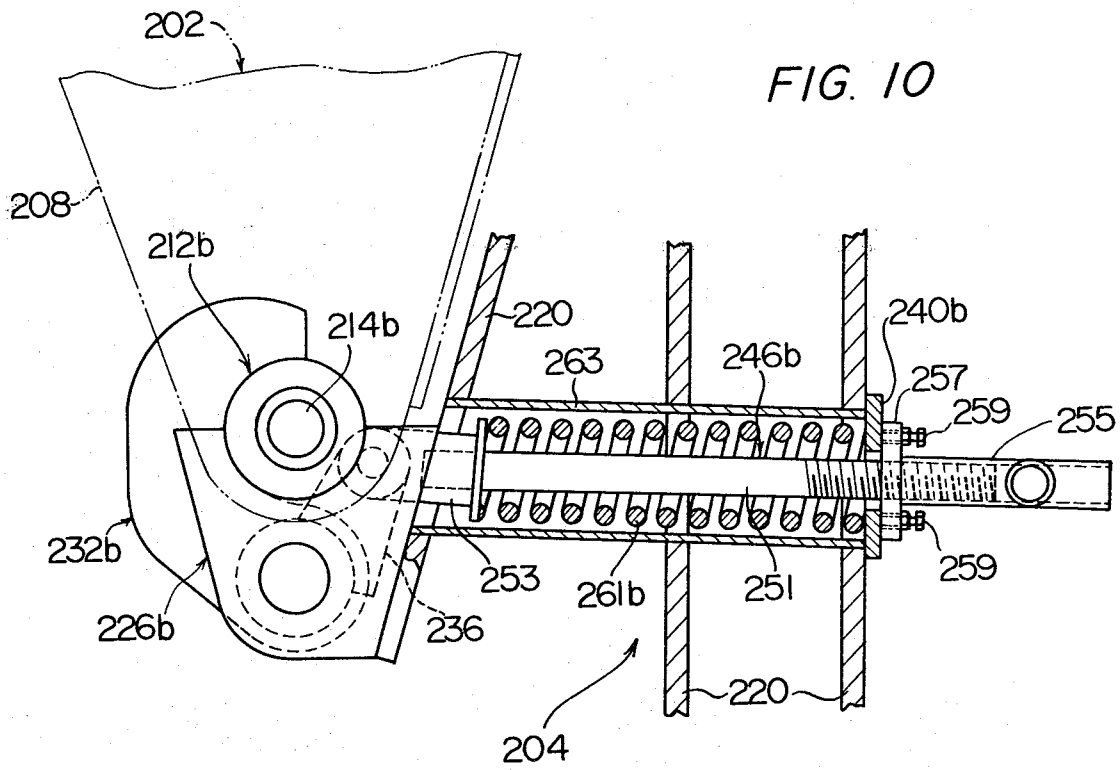

FIGS. 9 and 10 show a third embodiment of the bucket assembly constructed in accordance with this invention, which results from modification or change of the construction of the first and second power transmission members and the construction of the means for restricting the pivotal movement of the pivot member within a predetermined range in the first embodiment described hereinabove with reference to FIGS. 1 to 7.

In the third embodiment, each of a first power transmission member 246*a* and a second power transmission member 246*b* is made up of a rod 251. To one end (the right end in FIG. 9, and the left end in FIG. 10) of the rod 251 is fixed a connecting piece 252 which is pivotably connected to a connecting projection 236 of each of a first hook member 232*a* and a second hook member 232*b*. A connecting sleeve 255 is mounted on the other end (the left end in FIG. 9, and the right end in FIG. 10) of the rod 251. Preferably, the mounting of the connecting sleeve 255 is effected such that a male thread is formed on the peripheral surface of the aforesaid other end of the rod 251 and a female thread is formed on the inside surface of the connecting sleeve 255 so that the position of the connecting sleeve 255 with respect to the aforesaid other end of the rod 251 can be adjusted by changing the degree of threaded fitting between the female thread of the connecting sleeve and the male thread of the rod 251. An annular flange defining an abutting member 257 is integrally formed in the inside end of the connecting sleeve 255. As described in detail hereinbelow, the abutting member 257, upon the pivotable connection of the connecting sleeve 255 to a pivot member 238, serves to restrict the pivotal movement of the pivot member 238 by abutting against a first (or second) stop surface 240*a* (or 240*b*) defined by the surface of an annular member fixed to a support body 220.

The connecting sleeve 255 mounted on the aforesaid other end of the rod 251 is selectively connected to either the pivot member 238 or the support body 220. In the illustrated embodiment, the connecting sleeve 255 in the first power transmission member 246*a* shown in FIG. 9 is pivotably connected to the lower end portion of the pivot member 238. It will be readily appreciated from FIG. 9 that in such a case, the lower end portion of the pivot member 238 is connected to the connecting piece 236 of the first hook member 232*a* through the first power transmission member 246*a*, and the first hook member 232*a* is pivoted in response to the pivotal movement of the pivot member 238. On the other hand, the connecting sleeve 255 of the second power transmission member 246*b* shown in FIG. 10 is fixed at the site of the second stop surface 240*b* of the support body 220. The fixing of the connecting sleeve 255 can be achieved, for example, by inwardly projecting a bolt 259 provided in the annular flange defining the abutting member 257 through a screw hole formed in the annular flange to cause it to abut against the second stop surface 240*b*. As a result, the connecting projection 236 of the second hook member 232*b* is fixed directly to the support body 220 through the second power transmission member 246*b*, and the second hook member 232*b* is held at the operating position as shown in FIG. 10.

In the third embodiment shown in FIGS. 9 and 10, instead of providing a spring member in the first and second power transmission members in the first embodiment shown in FIGS. 1 to 7, a first spring member 261*a* and a second spring member 261*b* capable of elastically biasing the first and second hook members 232*a* and 232*b* respectively to inoperative positions are provided independently of the first and second power transmission members 246*a* and 246*b*. The first and second spring members 261*a* and 261*b* may be of any desired form which is conductive to the achievement of the desired action. In the illustrated embodiment, each of them is made up of a compression spring interposed between a flange formed intergrally at the inside end of the connecting piece 253 fixed to the aforesaid one end of the rod 251 and the support body 220 (more specifically, the inside surface of the annular member defining the first stop surface 240*a* or the second stop surface 240*b*). As can be readily appreciated from FIG. 9, the first spring member 261*a* provided with regard to the first hook member 232*a* shown in FIG. 9, in the illustrated state, exerts an elastically biasing action on the first hook member 232*a* through the rod 251 to thereby bias the hook member 232*a* to an inoperative position shown by the two-dot chain line in FIG. 9, and brings about the effect to be described in detail below. On the other hand, the second spring member 261*b* provided with regard to the second hook member 232*a* shown in FIG. 10 is maintained in the compressed state because the second hook member 232*b* is mechanically held or locked at the operating position by the fixing of the aforesaid other end of the second power transmission member 246*b* to the support body 220. In the illustrated embodiment, a cylindrical protective cover 263 is fixed to the support body 220 to protect each of the first and second spring members 261*a* and 261*b*.

Except the above-described construction of the third embodiment shown in FIGS. 9 and 10, the third embodiment is substantially the same in construction as the first embodiment shown in FIGS. 1 to 7.

The operating effect brought about by the first spring member 261*a* (or the second spring member 261*b*) in the third embodiment illustrated in FIGS. 9 and 10 is described below in detail.

Firstly, the first spring member 261*a* (or the second spring member 261*b*) has the same shock absorbing action as the first operating effect of the spring member provided in the first and second power transmission members in the first embodiment shown in FIGS. 1 to 7. Specifically, when the hydraulic cylinder mechanism (not shown in FIGS. 9 and 10; see FIG. 1) is stretched to turn the bucket 202 to the left side dumping position (see the position shown by the two-dot chain line in FIG. 1), a considerable force of impact corresponding to the speed of stretching the hydraulic cylinder mechanism is generated owing to an inertia of rotation of the bucket 202 upon stopping the stretching of the hydraulic cylinder mechanism. because of this force of impact, a considerable pulling force is exerted on the pivot member 238, the first power transmission member 246*a* and the first hook member 232*a*. Thus, the pivot member 238 is pivoted clockwise in FIG. 9, and therefore, the first hook member 232*a* is turned counterclockwise in FIG. 9. Since, however, the first hook member 232*a* is elastically biased to the inoperative position by the first spring member 261*a* (therefore, in the clockwise direction in FIG. 9), the counterclockwise turning of the first hook member 232*a* due to the aforesaid force of impact is performed in resistance to the elastic biasing power of the first spring member 261*a* and thus, the first spring member 261*a* is compressed. Hence, when the above impact and pulling forces become considerably large, they are elastically absorbed by the compression of the first spring member 261*a* to accurately prevent considerable vibration and noises and the damage of the bucket assembly or lift arms of the earthmoving machine, which are ascribed to these impact and pulling forces. In this connection, it is important in the third embodiment shown in FIGS. 9 and 10 that when a first support portion 212*a* (or a second support portion 212*b*) is detached from a first supporting portion 226*a* (or a second supporting portion 226*b*) provided in the support body 220, the first hook member 232*a* (or the second hook member 232*b*) should be adapted to pivot counterclockwise in FIG. 9 by an amount exceeding a predetermined amount past the operating position shown by the solid line in FIG. 9 in resistance to the elastic biasing action of the first spring member 261*a* (or the second spring member 261*b*). When the above impact and pulling forces which are generated temporarily have disappeared, the pivot member 238, the first power transmission member 246*a* and the first hook member 232*a* return to the state shown by the two-dot chain line in FIG. 9.

Secondly, the first spring member 261*a* (or the second spring member 261*b*) brings about the following operating effect not seen in the first embodiment shown in FIGS. 1 to 7.

When the bucket 202 is returned from the left side dumping position (see the position shown by the two-dot chain line in FIG. 1) to the operating position (see the position shown by the solid line in FIG. 1) by contracting the hydraulic cylinder mechanism, the weight of the bucket 202, in a normal state, acts in a direction to shrink the hydraulic cylinder mechanism. It will be readily appreciated however that when a bucket support 204 and the bucket 202 are tilted forward to a limit or its vicinity to bring a second pivot pin 214*b* to a vertical or nearly vertical position, the weight of the bucket 202 does not act in a direction to contract the hydraulic cylinder mechanism. When in this case, the hydraulic cylinder is contracted so as to return the bucket 202 to the operating position, the weight of the bucket 202 resists the contracting of the hydraulic cylinder mechanism. Accordingly, before the bucket 202 is returned to the operating position, the pivot member 238 tends to be turned clockwise in FIG. 9 to a position shown by the solid line to pivot the first hook member 232*a* counterclockwise in FIG. 9 to a position shown by the solid line. It will be readily appreciated that when the first hook member 232*a* is brought to the operating position before the bucket 202 is returned to the operating position, the first hook member 232*a* at the operating position hampers the engagement of the first support portion 212*a* with the first supporting portion 226*a* of the support body 220, and the bucket 202 is unable to return to the operating position. According to the third embodiment, by the action of the first spring member 261*a* elastically biasing the first hook member 232*a* to the inoperative position, the first hook member 232*a* is held at the inoperative position until the bucket 202 returns completely to the operating position. In this connection, it is important that the elastic biasing power of the first spring member 261*a* to bias the first hook member 232*a* elastically to the inoperative position should exceed the resistance of the weight of the bucket 202 to the contracting of the hydraulic cylinder mechanism in the state described hereinabove.

Except the aforesaid operating effects, the third embodiment shown in FIGS. 9 and 10 is substantially the same in operating effect as the first embodiment illustrated in FIGS. 1 to 7.

It needs hardly be said that while the present invention has been described hereinabove with regard to some specific embodiments of the bucket assembly constructed in accordance with the invention illustrated in the accompanying drawings, the invention is not limited to these specific embodiments, and various changes and modifications are possible with departing from the spirit and scope of the invention.

What we claim is:

1. In a bucket assembly for earth moving machines which is capable of side dumping as well and comprises a bucket, a bucket support and a hydraulic cylinder mechanism having a cylinder and a rod and interposed between the bucket and the bucket support, the improvement;

wherein the bucket includes a bucket body, a first receiving portion and a second receiving portion provided at opposite upper side portions of the rear surface of the bucket body, and a first support portion and a second support portion provided at opposite lower side portions of the rear surface of the bucket body and having a first pivot pin and a second pivot pin extending nearly at right angles to the widthwise direction of the bucket body;

wherein the bucket support comprises a support body to be mounted on lift arms and tilt links of an earth-moving machine, a first supporting portion and a second supporting portion provided in the support body for receiving the first and second support portions of the bucket respectively from above and supporting them therein, a first hook member and a second hook member mounted such that they pivot between an operating position at which they respectively come into engagement with the first and second support portions of the bucket to hold the first and second support portions in the first and second supporting portions and an inoperative position at which they move away from the first and second support portions of the bucket respectively, a pivot member pivotably mounted on the support body, a first stop surface and a second stop surface for restricting the pivotal movement of the pivot member within a predetermined range, a first power transmission member having one end connected to the first hook member and the other end selectively connected to the pivot member or the support body, and a second power transmission member having one end connected to the second hook member and the other end selectively connected to the support body or the pivot member; and wherein one of the cylinder and the rod of the hydraulic cylinder mechanism is pivotably connected selectively to either the second or first receiving portion of the bucket, and the other of the cylinder and the rod of the hydraulic cylinder mechanism is pivotably connected to the pivot member.

2. The bucket assembly of claim 1 wherein the first and second support portions of the bucket respectively have a first roller and a second roller rotatably fitted over the first and second pivot pins respectively, and the first and second hook members of the bucket support come into engagement with the first and second rollers respectively at the operating position.

3. The bucket assembly of claim 1 or 2 wherein each of the first and second power transmission members includes a cylindrical member, a rod extending through the cylindrical member, a stopping piece in the rod for restricting the relative movement of the rod in a predetermined direction with respect to the cylindrical member by its abutting against the cylindrical member, and a spring member disposed within the cylindrical member for elastically biasing the rod in the predetermined direction with respect to the cylindrical member, one end of the rod being adapted for connection to the first or second hook member, and the cylindrical member being adapted for connection to the pivot member or the other end of the rod being adapted for connection to the support body; and wherein when the one end of the rod is connected to the first or second book member and the cylindrical member is connected to the pivot member, the pivotal movement of the pivot member toward the first or second stop surface caused by the actuation of the hydraulic cylinder mechanism is transmitted to the first or second hook member through the cylindrical member, the stopping piece and the rod to thereby turn the first or second hook member from the operating position to the inoperative position, and on the other hand, the pivotal movement of the pivot member away from the first or second stop surface caused by the actuation of the hydraulic cylinder is transmitted to the first or second hook member through the cylindrical member, the spring member and the rod to thereby turn the first or second hook member from the inoperative position to the operating position.

4. The bucket according to claim 1 or 2 wherein the bucket support includes a first spring member and a second spring member provided in relation to the first and second hook members respectively for elastically biasing the first and second hook members to the inoperative position.

5. The bucket assembly of claim 4 wherein the first and second spring members of the bucket support are interposed respectively between the support body and the first or second power transmission member.

6. The bucket assembly of claim 4 wherein a first abutting member and a second abutting member are mounted respectively on the other ends of the first and second power transmission members of the bucket support in such a manner that their positions can be freely adjusted, and wherein the pivotal movement of the pivot member is restricted by the abutting of the first or second abutting member against the first or second stop surface when the other end of the power transmission member is connected to the pivot member.

7. The bucket assembly of any one of claims 1 or 2 wherein the hydraulic cylinder mechanism is a one rod-type hydraulic cylinder mechanism comprising a cylinder having its head end side connected pivotably to the pivot member and a rod having its end pivotably connected selectively to either the second or first receiving portion.

8. The bucket assembly of any one of claims 1 or 2 wherein the hydraulic cylinder mechanism is a two rod-type hydraulic cylinder mechanism comprising a cylinder with its intermediate part being pivotably connected to the pivot member and rods projecting from the opposite ends of the cylinder, one end of each rod being selectively connected to either the second or first receiving portion of the bucket.

* * * * *